US011498233B2

(12) United States Patent
Volk

(10) Patent No.: US 11,498,233 B2
(45) **Date of Patent: *Nov. 15, 2022**

(54) QUILT BINDING CUTTING GUIDE

(71) Applicant: Sandra J. Volk, Petersburg, AK (US)

(72) Inventor: Sandra J. Volk, Petersburg, AK (US)

( * ) Notice: Subject to any disclaimer, the term of this patent is extended or adjusted under 35 U.S.C. 154(b) by 142 days.

This patent is subject to a terminal disclaimer.

(21) Appl. No.: 16/896,497

(22) Filed: Jun. 9, 2020

(65) Prior Publication Data

US 2020/0298432 A1 Sep. 24, 2020

Related U.S. Application Data

(63) Continuation of application No. 16/299,612, filed on Mar. 12, 2019, now Pat. No. 10,695,925.

(51) Int. Cl.

| | |
|---|---|
| ***B26B 29/06*** | (2006.01) |
| ***D06H 7/10*** | (2006.01) |
| ***D05B 91/00*** | (2006.01) |
| ***B26B 25/00*** | (2006.01) |

(52) U.S. Cl.

CPC ..... *B26B 29/06* (2013.01); *B26B 25/005* (2013.01); *D05B 91/00* (2013.01); *D05D 2305/08* (2013.01); *D06H 7/10* (2013.01)

(58) Field of Classification Search

CPC ..... D06H 7/00; D06H 7/10; D05D 2305/08; B26B 29/06

See application file for complete search history.

(56) References Cited

U.S. PATENT DOCUMENTS

| | | | |
|---|---|---|---|
| 5,557,996 | A | 9/1996 | Reber |
| 6,543,141 | B1 | 4/2003 | Biehl |
| 6,862,823 | B2 | 3/2005 | deCarteret |
| 7,464,480 | B2 | 12/2008 | Vetromila |
| 7,730,842 | B1 | 6/2010 | Sebrow |
| 7,854,073 | B1 | 12/2010 | Webb |
| 8,156,877 | B1 | 4/2012 | Carr |
| 8,186,072 | B1 | 5/2012 | Nethery |
| 9,138,904 | B2 | 9/2015 | Thomas |
| D778,181 | S | 2/2017 | Colleran |
| 9,624,612 | B2 | 4/2017 | Works |
| 2010/0223798 | A1 | 9/2010 | Zimmerman |
| 2011/0047804 | A1 | 3/2011 | Thomas |
| 2012/0231209 | A1 | 9/2012 | Grihalva |
| 2015/0322609 | A1 | 11/2015 | Breuker |
| 2016/0067873 | A1 | 3/2016 | Dickinson |

OTHER PUBLICATIONS

American Patchwork & Quilting "How to Cut Binding; A Step-by-Step Guide"; undated (Year: 2020).

OLFA Self-Healing Double Sided Rotary Mats, Amazon.com; Nov. 24, 2003.

*Primary Examiner* — Kenneth E Peterson

(74) *Attorney, Agent, or Firm* — Neustel Law Offices

(57) ABSTRACT

A quilt binding cutting guide and a method for using it to cut and form low-bulk, angled seams for quilt bindings. The quilt binding generally has a first end and a second end. The cutting guide may comprise a quilt edge line, a right binding cutline, and a left binding cutline, the right binding cutline and the left binding cutline being spaced apart from, and parallel to, each other, and angled with respect to the quilt edge line. To use the guide, a user may position the cutting guide on top of a quilt so that the quilt edge line is directly above a raw edge of the quilt. The user may then use the guide lines on the cutting guide to position and cut the ends of a quilt binding accurately, without measuring or marking.

14 Claims, 14 Drawing Sheets

QUILT BINDING CUTTING GUIDE

CROSS REFERENCE TO RELATED APPLICATIONS

The present application is a continuation of U.S. application Ser. No. 16/299,612 filed on Mar. 12, 2019, now U.S. Pat. No. 10,695,925. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a quilt binding cutting guide for efficiently and accurately cutting quilt bindings on an angle to proper length without measuring or marking required.

Related Art

Any discussion of the related art throughout the specification should in no way be considered as an admission that such related art is widely known or forms part of common general knowledge in the field.

Measuring tools for cutting quilt bindings are available, but they typically require measuring, marking, and pinning of the binding material in order to cut and make a seam that has an accurate, correct length so that it can be sewn onto the edge of a quilt without bunching of material, either of the quilt or the binding itself. Such measuring tools also do not aid a user in actually cutting a binding, which thus requires a separate step that must be performed accurately, apart from the measuring/marking process.

SUMMARY

An example embodiment is directed to a quilt binding cutting guide and a method for using it to cut and form low-bulk, angled seams for quilt bindings. The quilt binding generally has a first end and a second end. The cutting guide generally comprises a quilt edge line, a right binding cutline, and a left binding cutline, the right binding cutline and the left binding cutline being spaced apart from, and parallel to, each other, and angled with respect to the quilt edge line. To use the guide, a user may position the cutting guide on top of a quilt so that the quilt edge line is directly above a raw edge of the quilt. The user may adjust the position of the cutting guide so that the first end of the binding overlaps the right binding cutline when the first end is extended leftward along the raw edge of the quilt.

The guide is also positioned so that the second end of the binding overlaps the left binding cutline when the second end is extended rightward along the raw edge of the quilt. In this way, cutting the right end and the left end of the binding can be accomplished without moving the cutting guide, which also ensures that the ends of the binding will overlap when straightened.

The method further comprises positioning the first end on the cutting guide so that the raw binding edge proximate the first end is aligned along the quilt edge line, and then cutting the first end along the right binding cutline to create a first cut edge. A user may then position the second end on the cutting guide so that the raw binding edge proximate the second end is aligned along the quilt edge line, and may then cut the second end along the left binding cutline to create a second cut edge. The order of these operations is not critical, and the left side may be cut first and the right side may be cut second, for example.

Using the guide, with its spacing between the right binding cutline and the left binding cutline ensures that the first end and the second end of the quilt binding have an overlap created by the distance by which the right binding cutline and the left binding cutline are spaced apart. As a further step to forming the angle seam, a user may align the first cut edge and the second cut edge and sew them together.

In some example embodiments, the cutting guide comprises a self-healing mat. Further, the right binding cutline and the left binding cutline may be spaced apart by about 7⁄16". The quilt binding may comprise a lengthwise fold and a folded edge, wherein the first end is unfolded before it is cut, and wherein the second end is unfolded before it is cut. The cut ends are kept unfolded when they are sewn together, and they are typically sewn together with their finished faces together, so that when they are straightened out along the quilt edge and folded lengthwise, the stitching is invisible.

Although other angles are possible, the right binding cutline and the left binding cutline may be at a 45° angle to the quilt edge line, which will result in a quilt binding seam that is at a 45° angle to the raw edge of the quilt. Such a seam has reduced bulk compared to a seam formed at a 90° angle.

The cutting guide may further comprise a right dog ear cutline and a left dog ear cutline, each dog ear cutline being perpendicular to the quilt edge line. In use, the dog ear cutlines serve as guides to allow for uniform dog ears to be cut to remove material at the extreme tips of the binding ends, further reducing bulk in the resulting seam. To use the dog ear cutlines, a user places the quilt binding flat, unfolded on the guide, in the same position in which the end was cut, and then cuts the tip of the first end off along the right dog ear cutline, and also cuts the tip of the second end off along the left dog ear cutline.

In the example embodiments, a rotary cutter and a straightedge may be used to accurately cut the bindings. To do so, a user places the straightedge along the right binding cutline and cuts the first end along the straightedge with the rotary cutter, and also places the straightedge along the left binding cutline and cuts the second end along the straightedge, wherein the straightedge guides the rotary cutter along the right binding cutline and the left binding cutline.

There has thus been outlined, rather broadly, some of the embodiments of the quilt binding cutting guide in order that the detailed description thereof may be better understood, and in order that the present contribution to the art may be better appreciated. There are additional embodiments of the quilt binding cutting guide that will be described hereinafter and that will form the subject matter of the claims appended hereto. In this respect, before explaining at least one embodiment of the quilt binding cutting guide in detail, it is to be understood that the quilt binding cutting guide is not limited in its application to the details of construction or to the arrangements of the components set forth in the following description or illustrated in the drawings. The quilt binding cutting guide is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
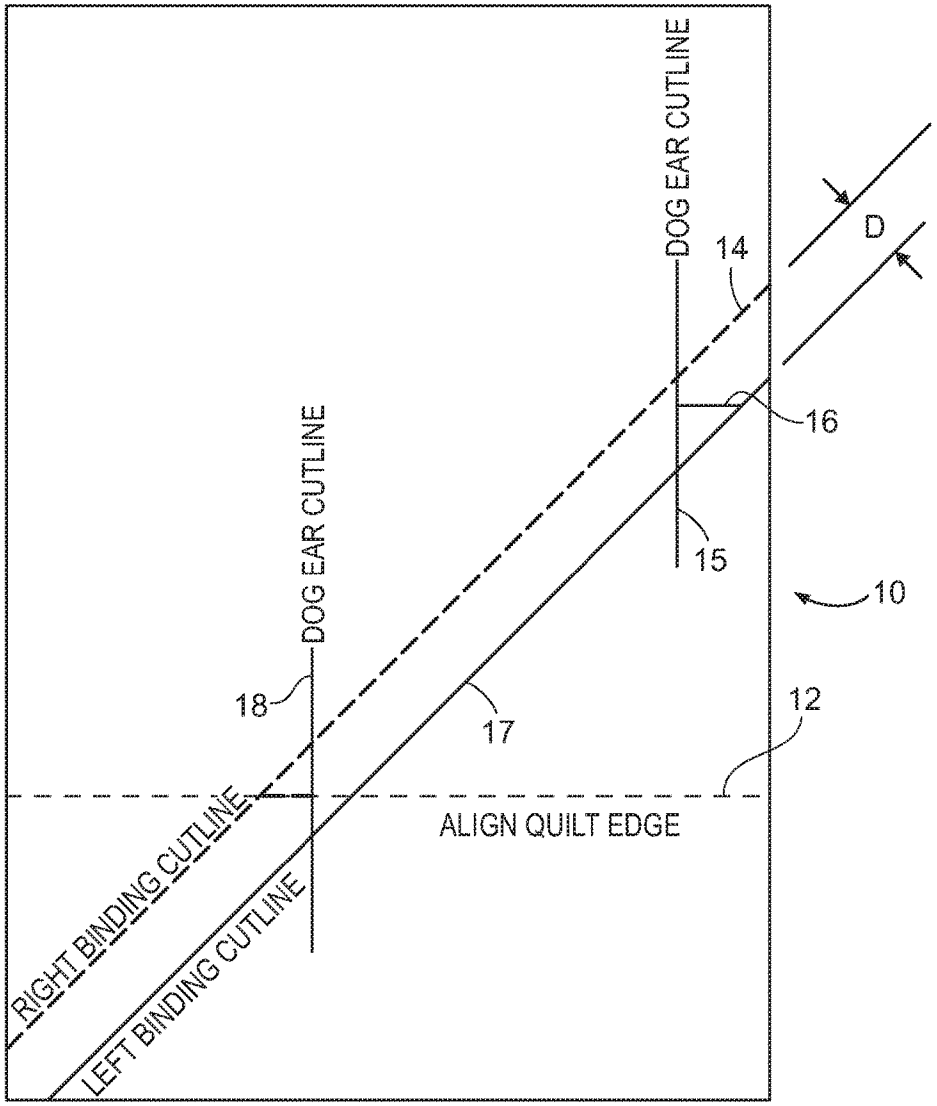
FIG. 1 is a top view of a quilt binding cutting guide in accordance with an example embodiment.

A. Overview.

An example quilt binding cutting guide 10 generally comprises a self-healing mat with special markings, including quilt edge line 12, a right binding cutline 14, and a left binding cutline 17, the right binding cutline 14 and the left binding cutline 17 being spaced apart from, and parallel to, each other, and angled with respect to the quilt edge line 12. To help the user remember which cutline to use, the lines may be different colors. As just one possible example, the right binding cutline may be red, so that a user may remember "right on red" to know which line to use when cutting the end of the right binding (i.e., the one on the user's right when facing the quilt 20 with the binding 30 partially sewn on). In addition, the cutting guide 10 may also have printed legends (such as "Right Binding Cutline", "Align Quilt Edge," etc.) to remind users of the function of each line or part of the guide.

The cutting guide 10 is used to cut and create neat, angled ends on a quilt binding quickly, without measuring, marking, or pinning. The right binding cutline 14 and the left binding cutline 17 may be marked at a 45° angle to the quilt edge line 12, which will result in a quilt binding seam 39 that is at a 45° angle to the raw edge 24 of the quilt 20. Such a seam has reduced bulk compared to a seam formed at a 90° angle.

Use of the cutting guide results in a uniform, predetermined overlap distance between the cut ends of the binding, so that sewing the ends together with a known seam spacing creates a binding of proper length that can be sewn onto the quilt. The guide need not be large, and in one example embodiment may be made from a 5×7" self-healing mat. The size is not critical, however, as different sized cutting guides will perform just as well. For example, the cutting guide 10 could be much smaller than 5×7 inches, and be used for smaller quilts. The cutting guide 10 may be used with standard, 2½" quilt bindings, but will work with other size bindings without any modifications being needed.

As one example, the two cutlines 14 and 17 may be spaced apart by a distance D, which may be 7/16", although other distances are of course possible. The distance D determines the amount of overlap that will exist between the ends 36, 38 of the quilt binding 30 after they are cut. To use the guide, a user may position the cutting guide 10 on top of a quilt so that the quilt edge line 12 is directly above a raw edge 24 of the quilt 20. The user may adjust the position of the cutting guide 10 so that the first end 36 of the binding 30 overlaps the right binding cutline 14 when the first end is extended leftward along the raw edge 24 of the quilt 20.

In use, the guide 10 is also positioned so that the second end 38 of the binding 30 overlaps the left binding cutline 17 when the second end 38 is extended rightward along the raw edge 24 of the quilt.

The method further comprises positioning the first end 36 on the cutting guide 10 so that the raw binding edge proximate the first end is aligned along the quilt edge line (i.e., directly above the raw edge of the quilt 20), and then cutting the first end 36 along the right binding cutline 14 to create a first or "right" cut edge 31. A user may then position the second binding end 38 on the cutting guide 10 so that the raw edge 34 of the binding proximate the second end 38 is aligned along the quilt edge line 12, and may then cut the second end at an angle along the left binding cutline 17 to create a second or "left" cut edge 37. The order of these operations is not critical, and the left side may be cut first and the right side may be cut second, for example.

Using the guide 10, with its spacing between the right binding cutline 14 and the left binding cutline 17 ensures that the first end 36 and the second end 38 of the quilt binding have an overlap created by the distance D by which the right binding cutline 14 and the left binding cutline 17 are spaced apart. As a further step to forming the angled seam 39, a user may align the first cut edge 31 and the second cut edge 37 and sew them together.

In some example embodiments, the cutting guide 10 comprises a self-healing mat. Further, the right binding cutline 14 and the left binding cutline 17 may be spaced apart by about 7/16". The quilt binding 30 may comprise a lengthwise fold, a folded edge 32, and a raw edge 34, wherein the first end 36 is unfolded before it is cut, and wherein the second end 38 is also unfolded before it is cut. The cut edges 31, 37 are kept unfolded when they are sewn together, and they are typically sewn together with their finished faces together, so that when they are straightened out along the quilt edge and folded lengthwise, the stitching is invisible, forming a seam 39.

The cutting guide 10 may further comprise a right dog ear cutline 18 and a left dog ear cutline 15, each dog ear cutline being perpendicular to the quilt edge line 12. In use, the dog ear cutlines serve as guides to allow for uniform dog ears to be cut to remove material at the extreme tips of the binding ends, further reducing bulk in the resulting seam. To use the dog ear cutlines, a user places the quilt binding flat, unfolded on the guide, in the same position in which the end was cut, and then cuts the tip of the first end off along the right dog ear cutline 18, and also cuts the tip of the second end off along the left dog ear cutline 15.

In the example embodiments, a rotary cutter 40 and a straightedge 50 may be used to accurately cut the bindings. To do so, a user places the straightedge 50 along the right binding cutline 14 and cuts the first end 36 along the straightedge 50 with the rotary cutter 40, and then places the straightedge 50 along the left binding cutline 17 and cuts the second end 38 along the straightedge 50, wherein the straightedge 50 guides the rotary cutter 40 along the right binding cutline 14 and the left binding cutline 17.

B. Operation of Preferred Embodiment

Figure 2:
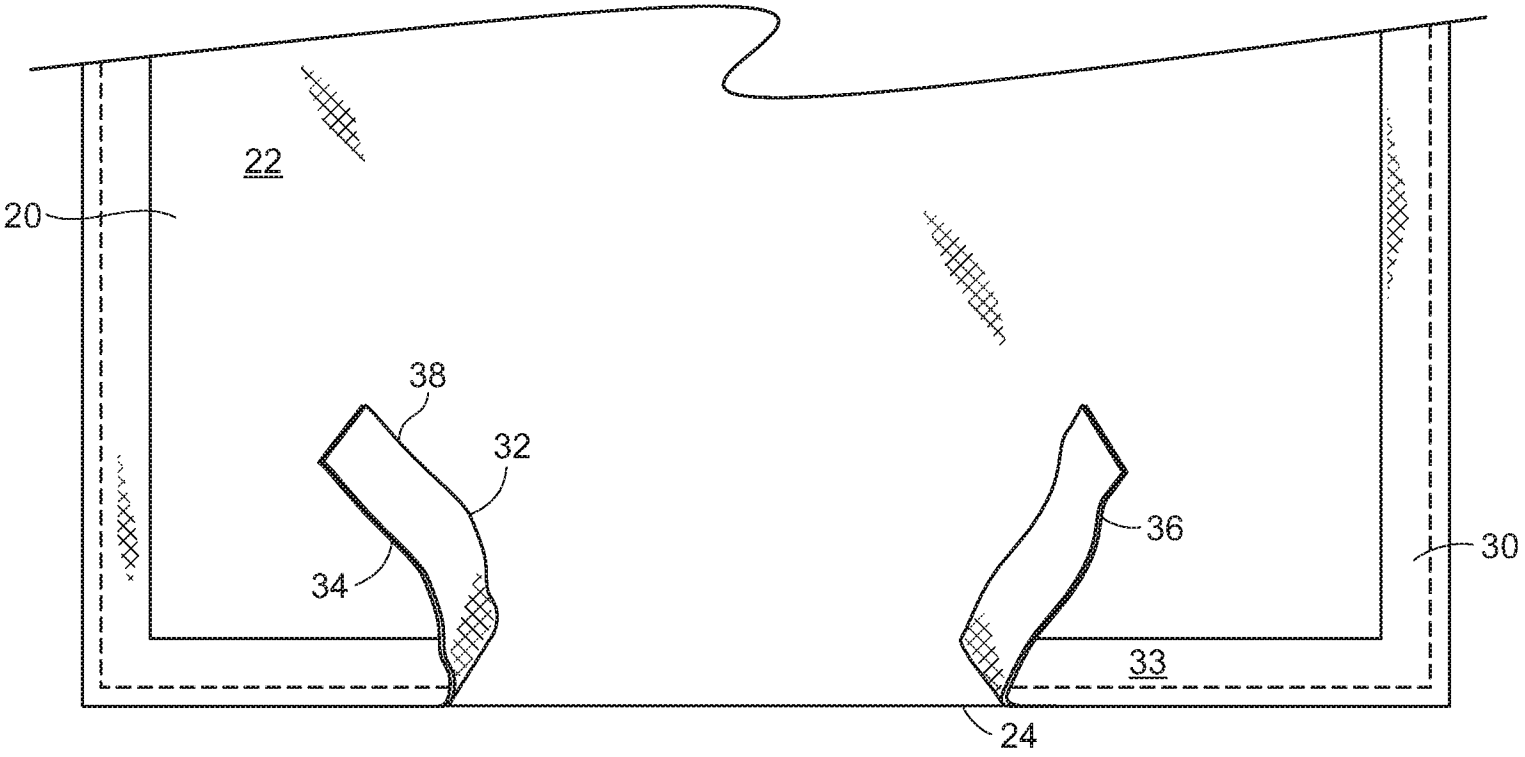
FIG. 2 is a top view of a quilt with a partially-attached binding sewn to its raw edge in accordance with an example embodiment.

In use, a quilter starts with a binding 30 that is partially sewn onto the raw edge 24 of a quilt 20, as best shown in FIG. 2. Typically, the binding is sewn onto the front face 22 of the quilt, and is also sewn so that the raw edge 34 of the binding is aligned on top of the raw edge 24 of the quilt 20. Also typically, the binding has a front 33 and a back 35, where the front 33 is meant to be visible, with any pattern and colors displayed.

As also shown, the ends 36 and 38 of the binding 30 are left longer than necessary so that they are ready to be finished, by cutting, joining, and sewing together. As mentioned, the binding is partially stitched onto the edge of the quilt, so that the finished length will not be affected by the binding being out of place. As also shown in FIG. 2, the ends of the binding are thus ready to be trimmed to length and sewn together to finish the quilt. To aid in this process, a cutting guide 10, as best shown in FIG. 1, may be used.

Figure 3:
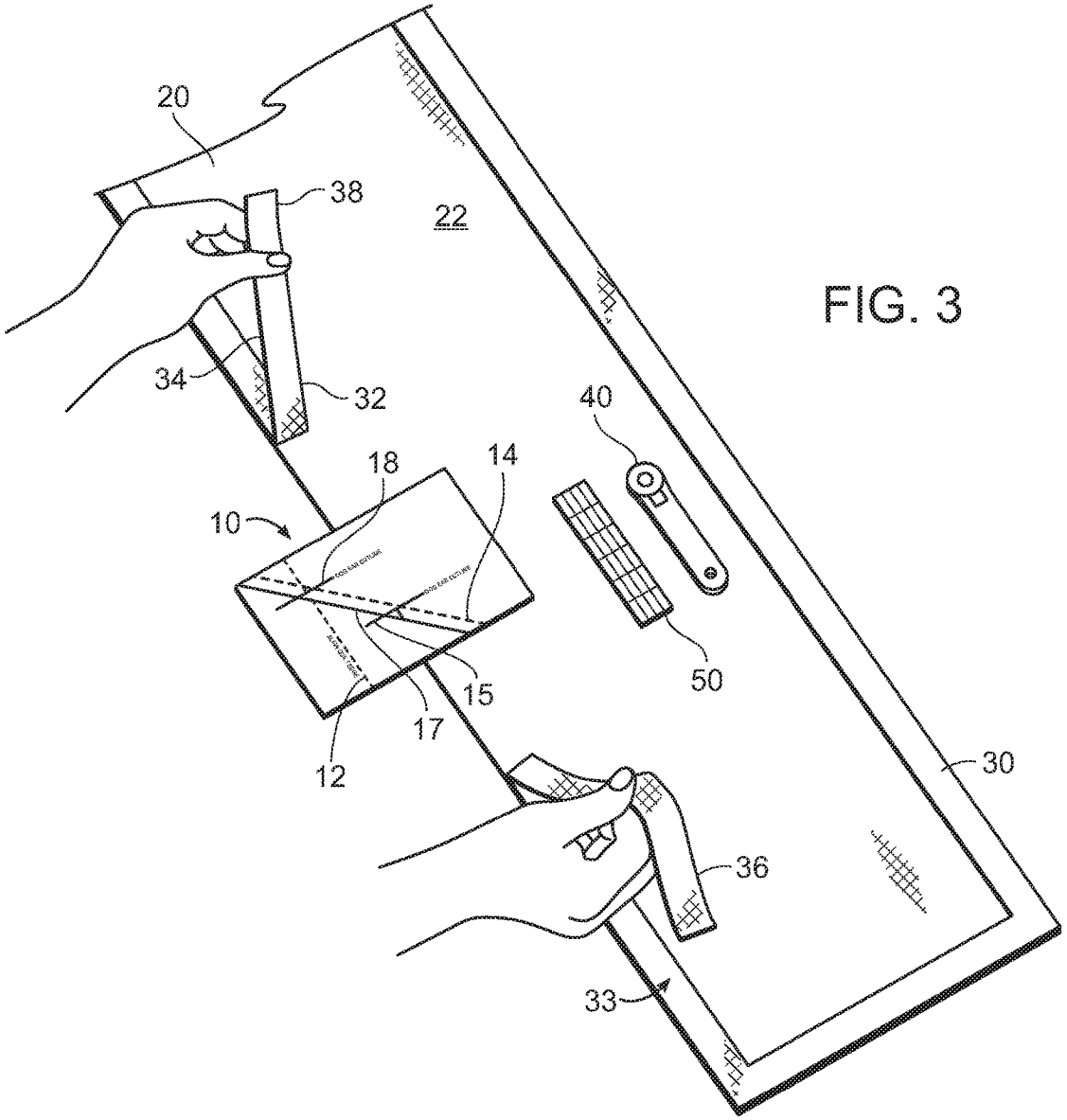
FIG. 3 is a perspective view of a quilt binding cutting guide being used in accordance with an example embodiment.
Figure 4:
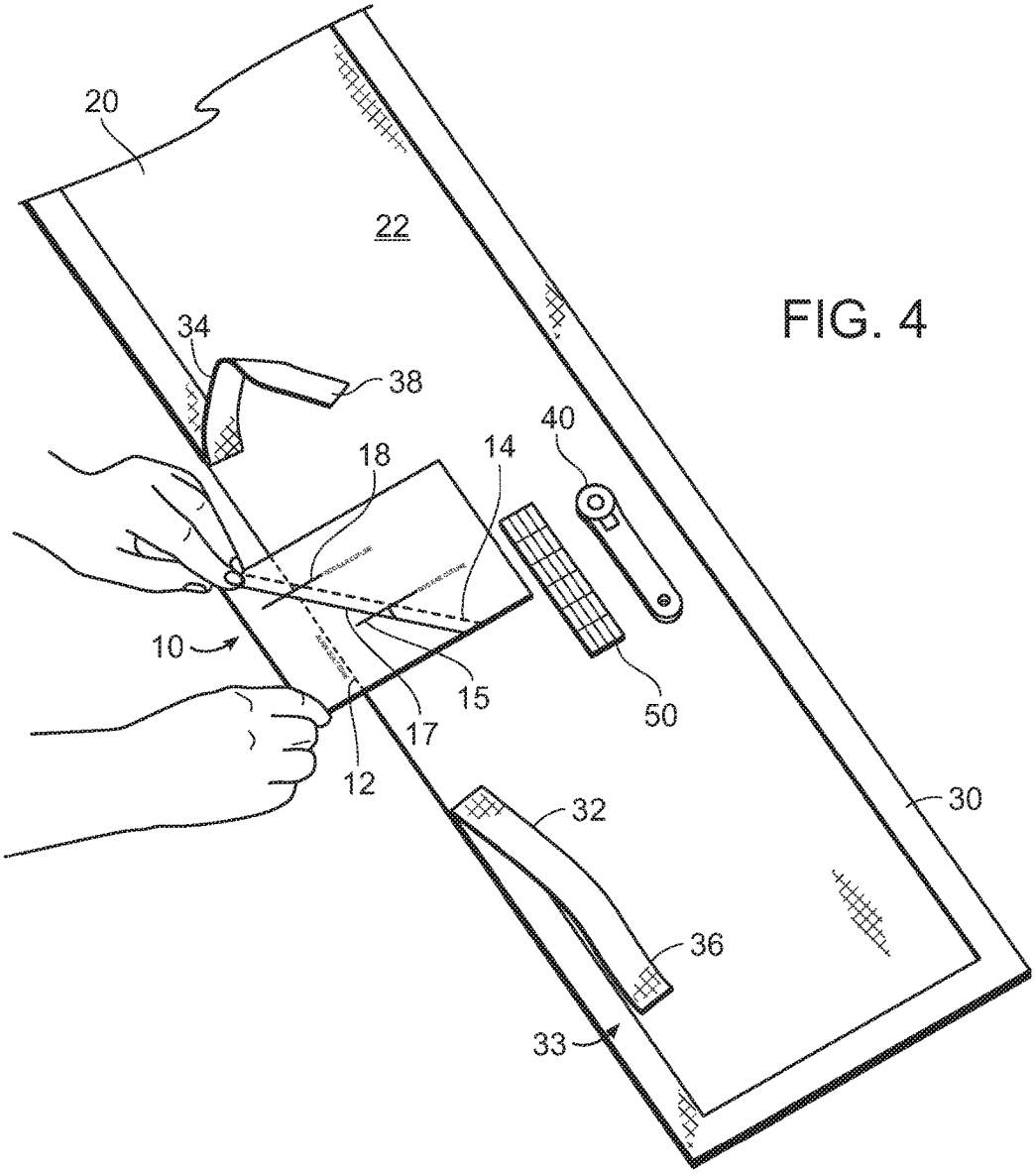
FIG. 4 is another perspective view of a quilt binding cutting guide being used in accordance with an example embodiment.

Starting with a quilt 20 ready for binding as shown, the cutting guide 10 is first placed onto the final raw edge 24 of the quilt, near where the unfinished ends of the binding 30 will come together. If necessary, the ends 36 and 38 of the binding are pulled away from the center or location on the quilt where they will ultimately meet, as shown in FIG. 3. At this point, the cutting guide is place in position on the raw edge 24 of the quilt 20, near where the binding ends meet. With the binding ends out of the way, a user may adjust the cutting guide so that the quilt edge line 12 is directly over the raw edge 24 of the quilt 20, as shown in FIG. 4.

Figure 5:
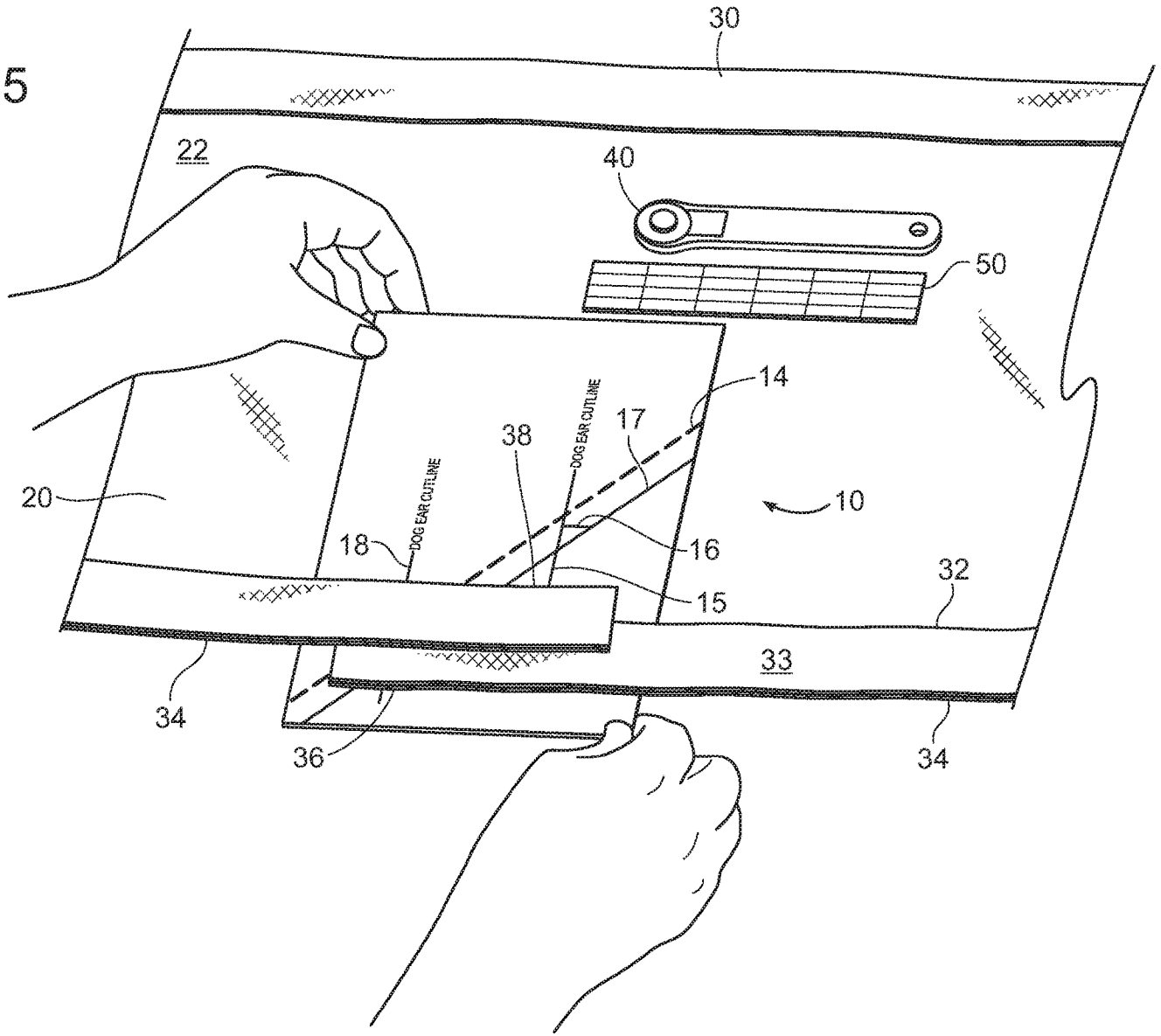
FIG. 5 is a perspective view of a quilt binding cutting guide being positioned on a quilt in accordance with an example embodiment.
Figure 6:
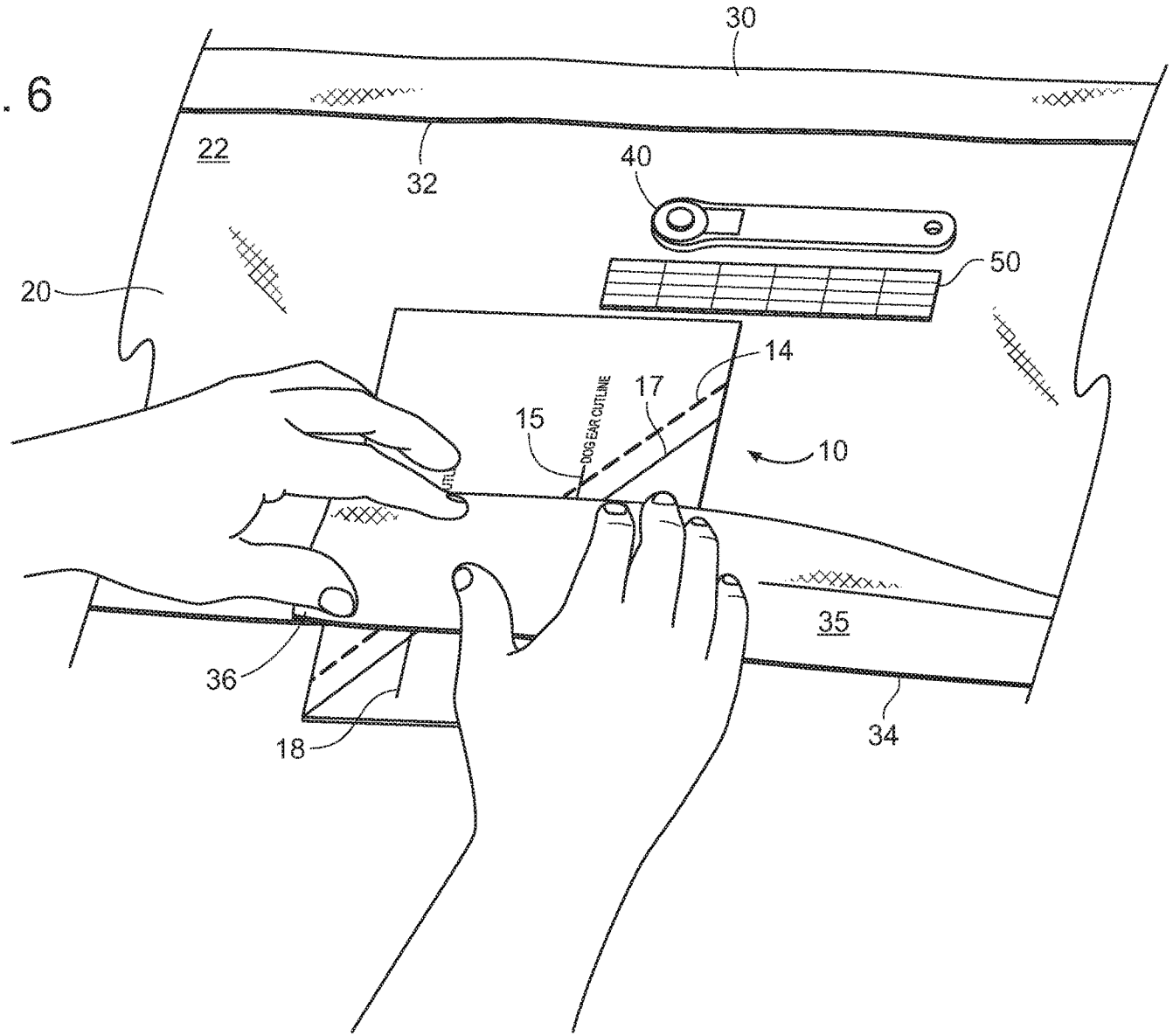
FIG. 6 is a perspective view of an end of a binding being positioned on a quilt binding cutting guide in accordance with an example embodiment.

Next, the binding ends 36, 38 are brought together along the edge of the quilt so that the cutting guide 10 may be moved left or right as needed so that the guide markings (e.g., cutlines 14 and 17) will be overlapped by the binding ends, as shown in FIG. 5, so that both ends can be cut using the guide without moving it once it is in position. As shown in FIG. 6, the left binding end having been moved away, the right end 36 is unfolded, and its raw edge 34 is aligned and positioned to be directly over the quilt edge line 12. To make an accurate cut, the binding is pulled gently to the left to remove any slack, but not hard enough to stretch it or move the quilt. As also shown, this positioning results in the raw edge of the quilt and the unfolded binding being aligned, with the cutting guide 10 being between them, to provide a cutting base as well as a guide for making an angled cut on the right end 36 of the binding 30.

Figure 7:
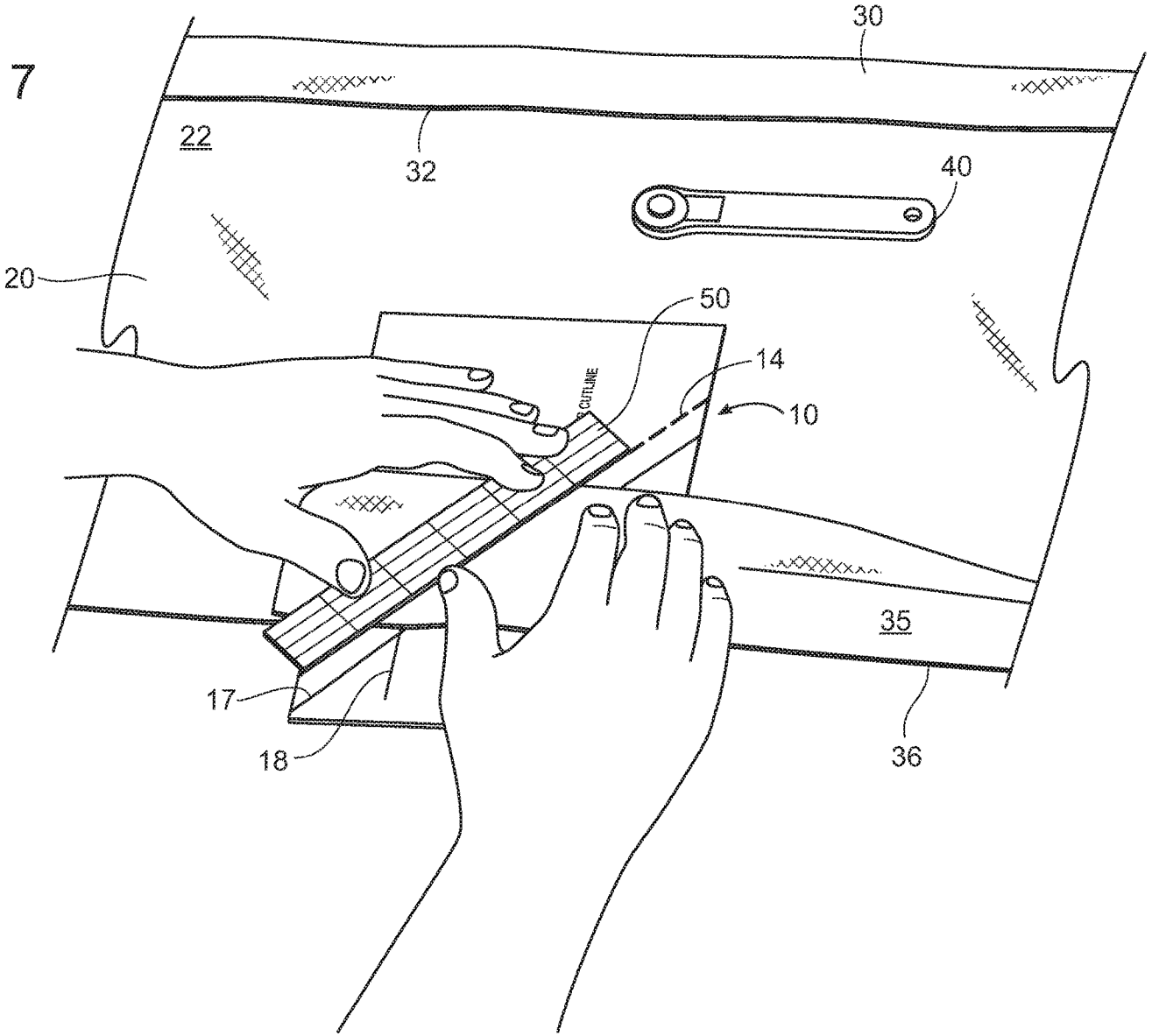
FIG. 7 is a perspective view of an end of a binding being prepared for cutting on a quilt binding cutting guide in accordance with an example embodiment.
Figure 8:
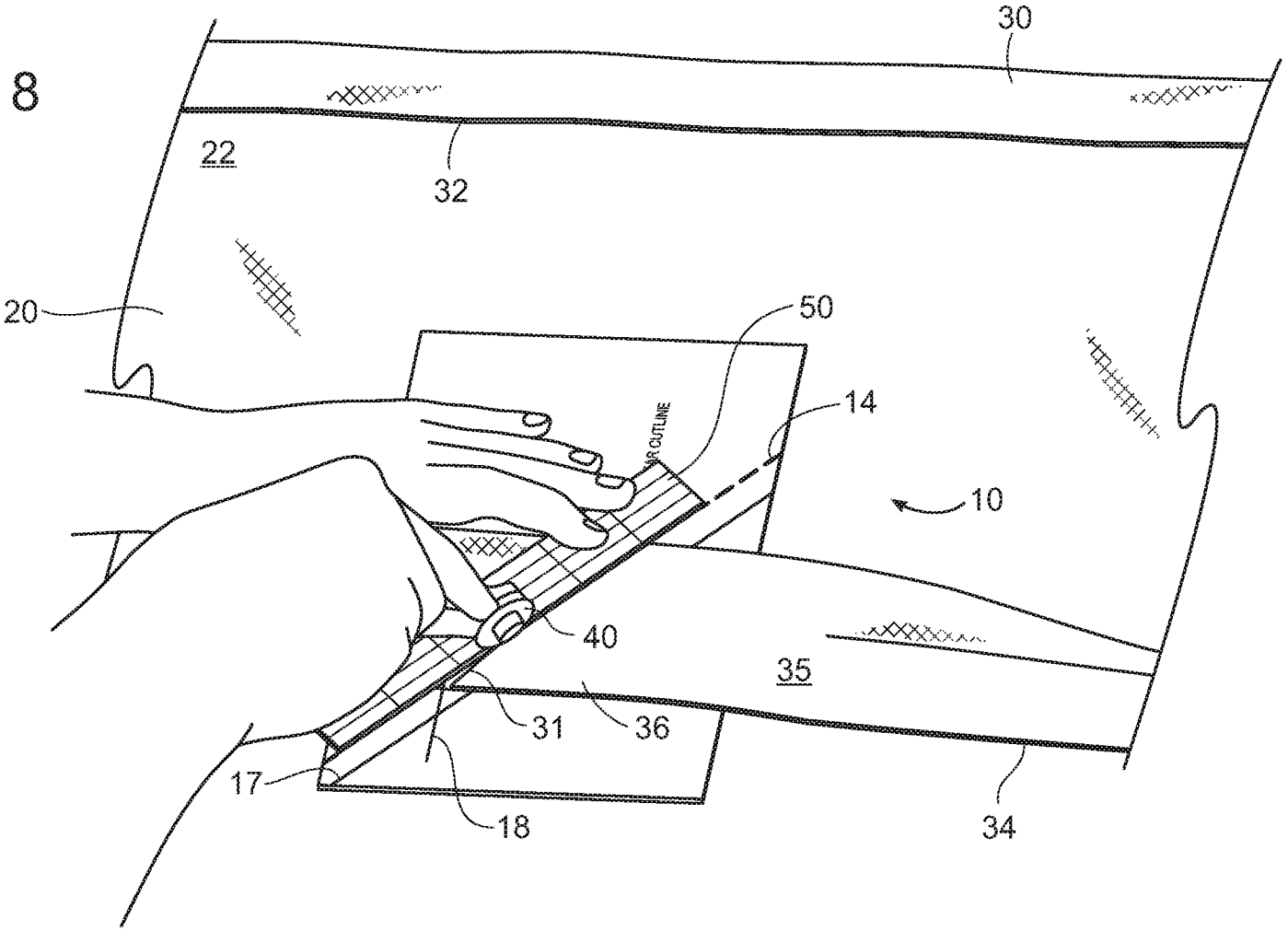
FIG. 8 is a perspective view of an end of a binding being cut on a quilt binding cutting guide in accordance with an example embodiment.
Figure 9:
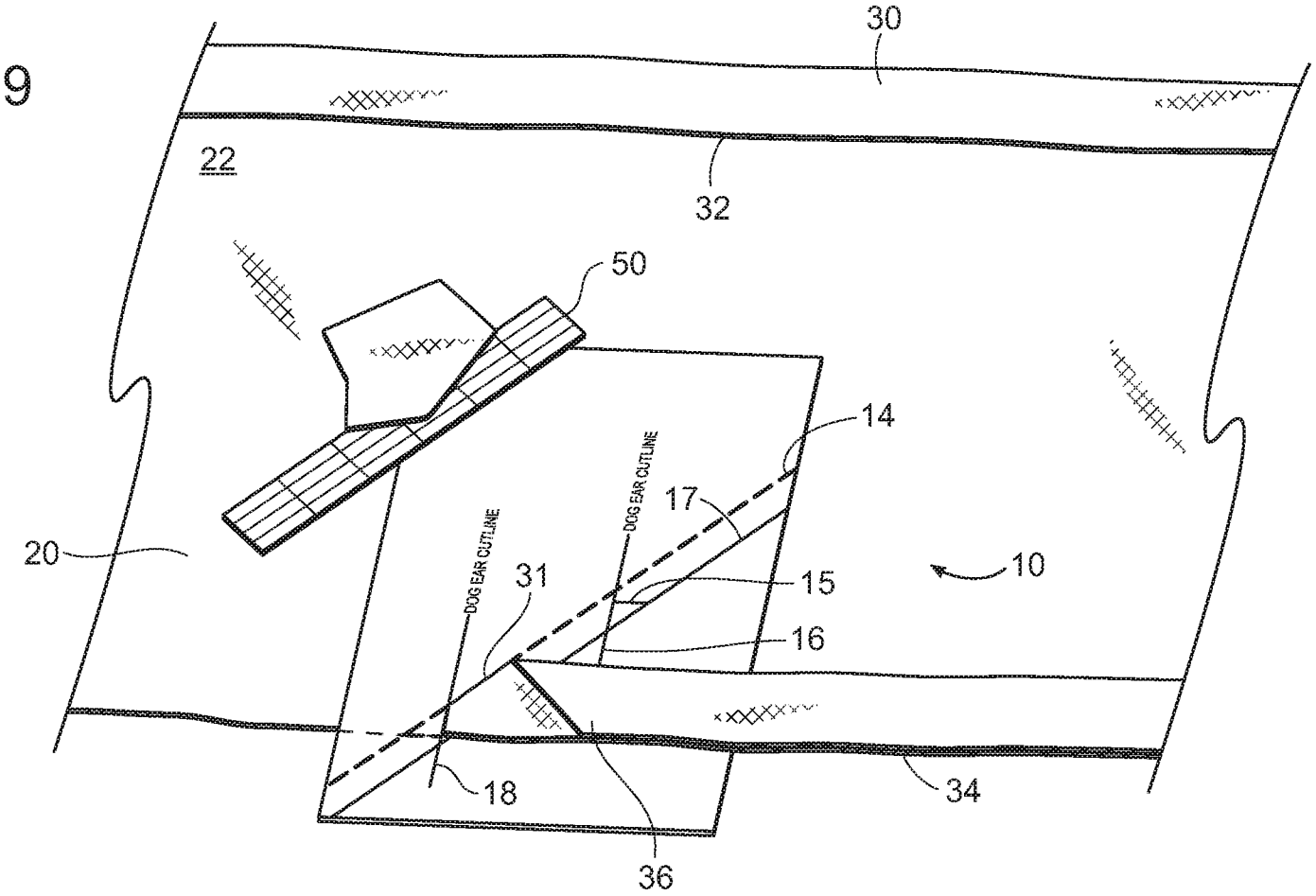
FIG. 9 is a perspective view of an end of a binding after cutting on a quilt binding cutting guide in accordance with an example embodiment.

As shown in FIGS. 7-8, a straightedge 50 is laid over the binding end to be cut, aligned with one edge over the right binding cutline 14, which may be red to differentiate it from the left binding cutline. Next, a rotary cutter 40 may be used along the edge that is aligned with the right binding cutline 14 to make an accurate cut on the cutting guide 10. This cut will result in the end 36 of the binding having a right cut edge 31, which will later be sewn to the similar left cut edge 37. Optionally, the sharp tip of the binding that remains can be cut oft again using the straightedge 50, the rotary cutter 40, and the right dog ear cutline 18 on the cutting guide 10, as shown in FIG. 9. Removal of this dog ear can further reduce the bulk of the resulting seam.

Figure 10:
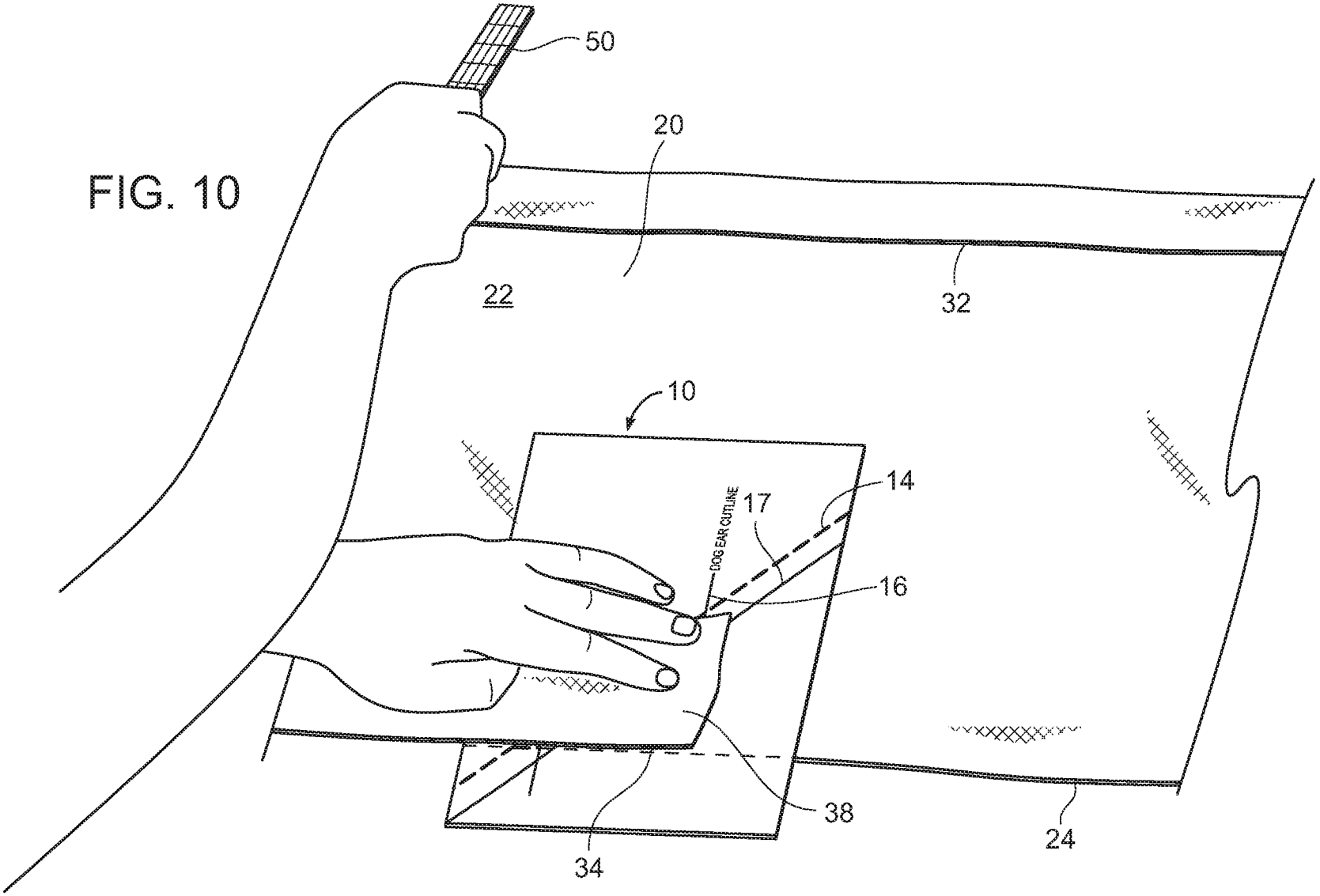
FIG. 10 is a perspective view of a second end of a binding being positioned on a quilt binding cutting guide in accordance with an example embodiment.
Figure 11:
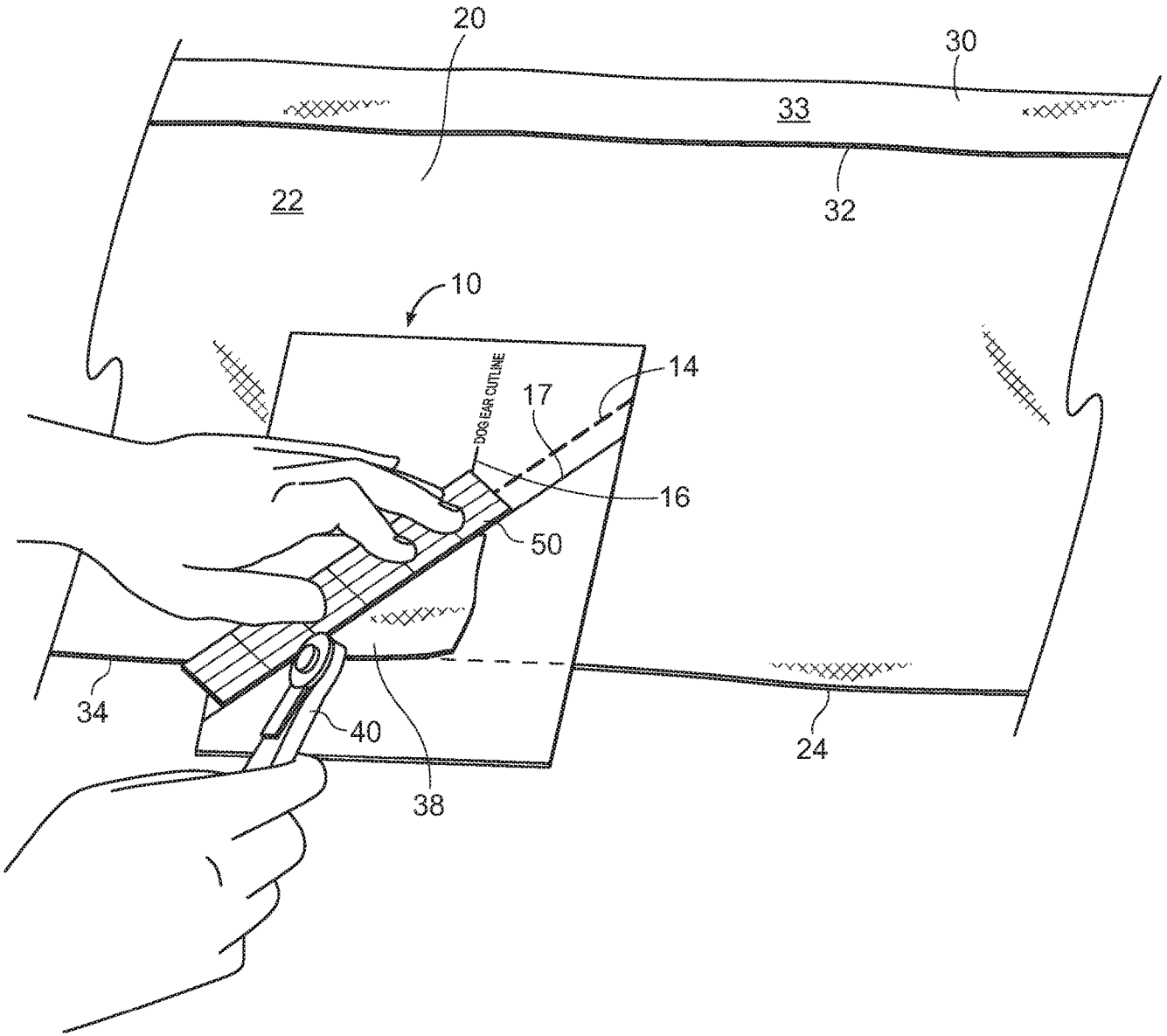
FIG. 11 is a perspective view of a second end of a binding being cut on a quilt binding cutting guide in accordance with an example embodiment.
Figure 12:
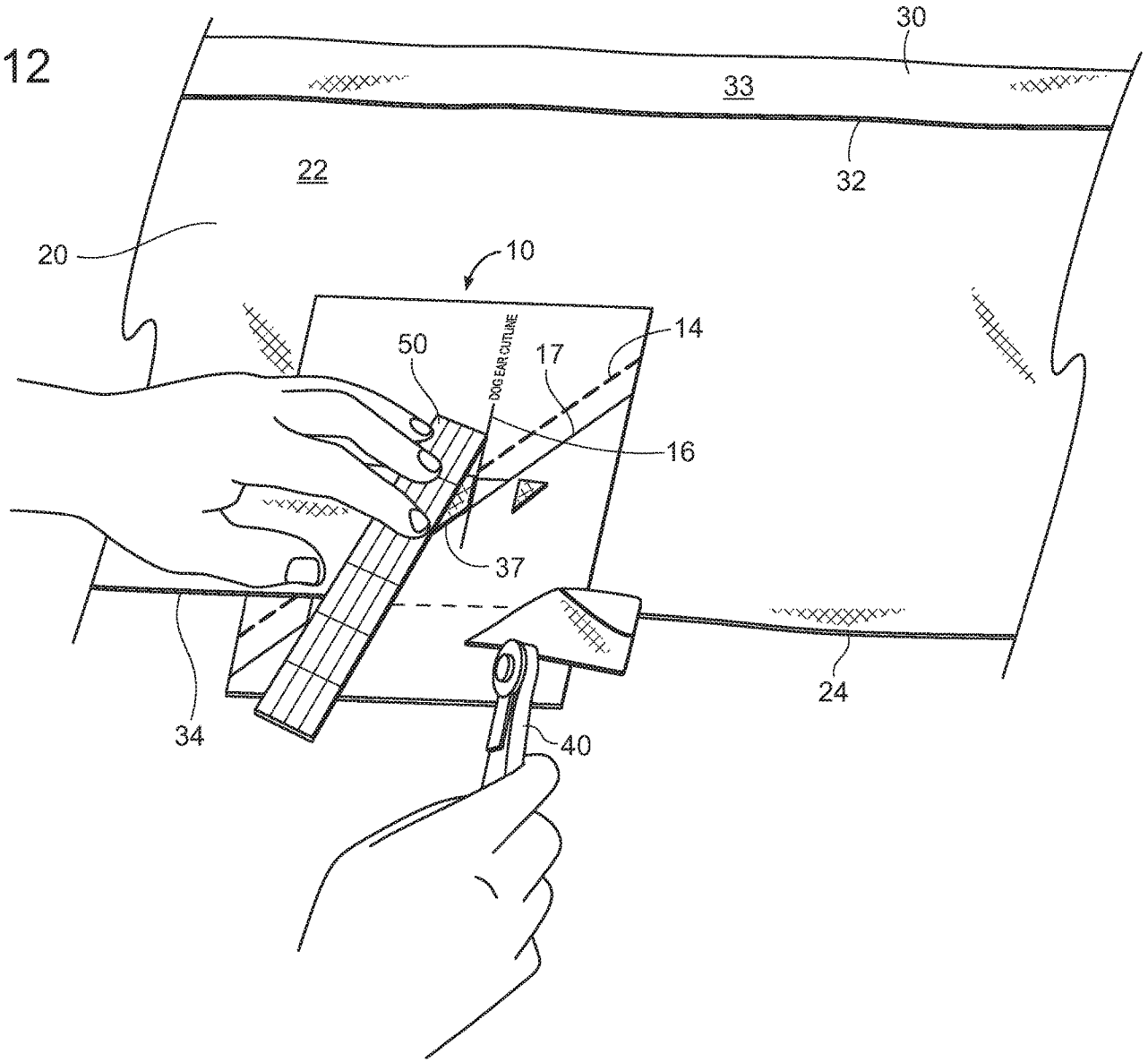
FIG. 12 is a perspective view of a second end of a binding after cutting on a quilt binding cutting guide in accordance with an example embodiment.

As shown in FIGS. 10-12, this process is repeated for the left end 38 of the quilt binding 30, using the left binding cutline 17 on the cutting guide 10 to cut the left binding aligned with its raw edge on the quilt edge line 12 of the guide. As mentioned above, the spacing between the right binding cutline 14 and the left binding cutline 17 will result in a consistent, predetermined amount of overlap of the binding ends. Although different spacing is possible, the distance D on the cutting guide 10, 7/16", will result in a perfect seam 39, with the binding having a proper length along the quilt edge (see FIG. 14) when a ¼" seam is sewn as shown in FIG. 13.

As with the right end, making this cut results in left cut edge 37. The sharp point of fabric left by the cut can also be removed using the left dog ear cutline 15 and the left dog ear guideline 16. The dog ear may be removed using the straightedge 50 and the rotary cutter 40. As mentioned above, the cutting guide 10 can be used to cut bindings of different widths, with 2½" bindings being typical. If smaller or larger bindings are being used, the guideline 16 may be needed. Specifically, with a smaller or larger binding, the corner of the left edge 37 will not be positioned properly on the left binding cutline 17 to cut the dog ear. In that case, the binding corner can simply be positioned so that the corner fits in the triangle formed by lines 15, 16, and 17, at which point the dog ear can be cut off along line 15, as best shown in FIG. 12.

Figure 13:
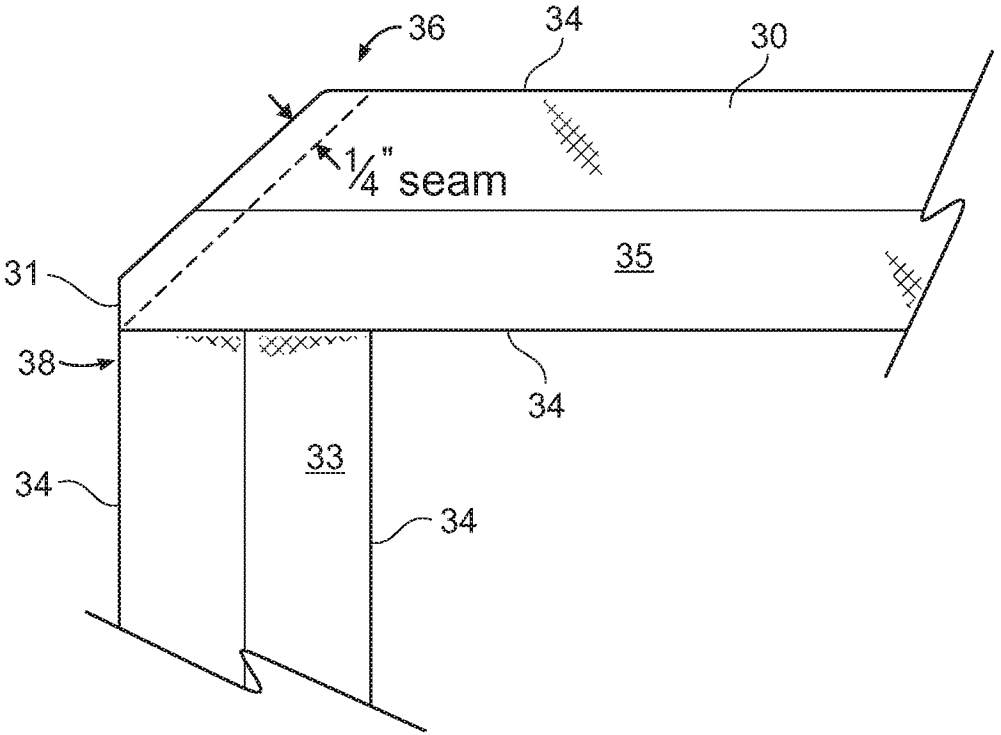
FIG. 13 is a top view of two ends of a binding sewn together after cutting on a quilt binding cutting guide in accordance with an example embodiment.
Figure 14:
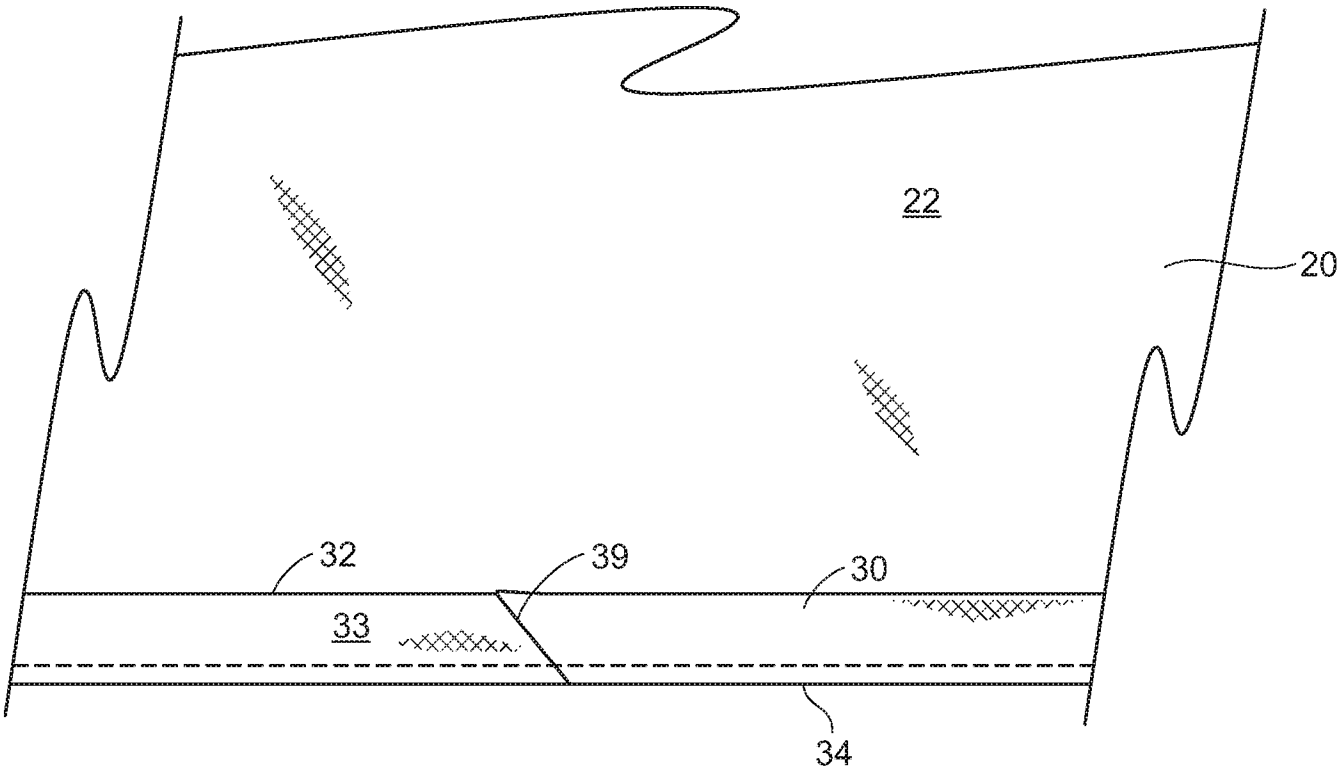
FIG. 14 is a top view of a finished seam of a binding sewn together after cutting on a quilt binding cutting guide in accordance with an example embodiment.

As shown in FIG. 13, once both binding ends have been cut, the ends 36 and 38 may be brought together, with their front sides 33 held together as shown, so that the stitching (e.g., a ¼" seam), will be visible on the back side 35 but not the front. The seam is sewn with the binding 30 unfolded. After sewing, the binding 30 will again be folded lengthwise, so that only the face 33 will be visible. Seam 39 will be invisible since it was sewn with faces 33 of each end together. As shown in FIG. 14, the folded edge 32 will now be continuous, as will raw edge 34, and the entire binding 30 can be sewn onto the quilt edge as shown.

In addition to forming a single seam, the cutting guide can also be used to cut multiple binding strips all at once. To do so, the strips may be stacked and placed on the right side and cut on the right binding cutline 14. Next, the entire stack can be moved to the left side of the cutting guide 10, and the ends can be cut on the left binding cutline 17, so that all the seams are in the same direction.

As also mentioned above, although the cutting guide 10 is designed for the common 2½" binding, it can also accommodate larger or smaller bindings, such as six-inch bindings, or those smaller than 2½".

Unless otherwise defined, all technical and scientific terms used herein have the same meaning as commonly understood by one of ordinary skill in the art to which this invention belongs. Although methods and materials similar to or equivalent to those described herein can be used in the practice or testing of the quilt binding cutting guide, suitable methods and materials are described above. All publications, patent applications, patents, and other references mentioned herein are incorporated by reference in their entirety to the extent allowed by applicable law and regulations. The quilt binding cutting guide may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A method of using a cutting guide for cutting a first end and a second end of a quilt binding having a raw binding edge, such that the first end and the second end have a predefined overlap, comprising:

providing the cutting guide, wherein the cutting guide comprises:

a self-healing mat;

a quilt edge line on the mat, usable to align a raw edge of a quilt and the raw binding edge of the quilt binding;

a right binding cutline on the mat, the right binding cutline having an acute angle to the quilt edge line; and a left binding cutline on the mat, the left binding cutline being parallel to and spaced apart from the right binding cutline;

wherein the left binding cutline and the right binding cutline are spaced apart to create the predefined overlap between the first end and the second end of the quilt binding when the first end is cut along the right binding cutline and the second end is cut along the left binding cutline;

positioning the cutting guide on top of a quilt so that the quilt edge line is directly above a raw edge of the quilt;

adjusting the position of the cutting guide so that the first end overlaps the right binding cutline when the first end is extended leftward along the raw edge of the quilt, and the second end overlaps the left binding cutline when the second end is extended rightward along the raw edge of the quilt;

positioning the first end on the cutting guide so that the raw binding edge proximate the first end is aligned along the quilt edge line;

cutting the first end along the right binding cutline;

positioning the second end on the cutting guide so that the raw binding edge proximate the second end is aligned along the quilt edge line; and cutting the second end along the left binding cutline.

2. The method of claim 1, wherein the right binding cutline and the left binding cutline are spaced apart by about 7/16".

3. The method of claim 1, wherein the quilt binding comprises a lengthwise fold, wherein the first end is unfolded before it is cut, and wherein the second end is unfolded before it is cut.

4. The method of claim 3, wherein cutting the first end creates a first cut end and wherein cutting the second end creates a second cut end, the method further comprising aligning the first cut end with the second cut end and sewing the first cut end to the second cut end when the binding is unfolded proximate the first cut end and the second cut end.

5. The method of claim 4, wherein the first cut end and the second cut end are sewn together to form a seam along a line parallel to and spaced apart from the first cut end and the second cut end.

6. The method of claim 5, wherein the seam is ¼" from the first cut end and the second cut end.

7. The method of claim 5, wherein the binding is partially sewn to the quilt along the raw edge of the quilt before the first and second ends are cut, so that the quilt binding can be sewn along the raw edge of the quilt to form a continuous quilt binding.

8. The method of claim 7, wherein the seam is not perpendicular to the raw edge of the quilt after the quilt binding is sewn along the raw edge of the quilt.

9. The method of claim 1, wherein the right binding cutline and the left binding cutline are at a 45° angle to the quilt edge line.

10. The method of claim 1, wherein the cutting guide further comprises a right dog ear cutline and a left dog ear cutline, each dog ear cutline being perpendicular to the quilt edge line, the method further comprising:

cutting a tip of the first end off along the right dog ear cutline; and cutting a tip of the second end off along the left dog ear cutline.

11. The method of claim 1, wherein cutting the first end and cutting the second end comprises using a rotary cutter.

12. The method of claim 11, wherein the step of cutting the first end comprises placing a straightedge along the right binding cutline and cutting the first end along the straightedge, and wherein the step of cutting the second end comprises placing the straightedge along the left binding cutline and cutting the second end along the straightedge, wherein the straightedge guides the rotary cutter along the right binding cutline and the left binding cutline.

13. A method of using a cutting guide for cutting a first end and a second end of a quilt binding having a raw binding edge, such that the first end and the second end have a predefined overlap, comprising:

providing the cutting guide, wherein the cutting guide comprises:

a self-healing mat;

a quilt edge line on the mat, usable to align a raw edge of a quilt and the raw binding edge of the quilt binding;

a right binding cutline on the mat, the right binding cutline having forming an angle of 45° to the quilt edge line;

a left binding cutline on the mat, the left binding cutline being parallel to and spaced apart from the right binding cutline;

a right dog ear cutline and a left dog ear cutline, each dog ear cutline being perpendicular to the quilt edge line, wherein the right dog ear cutline intersects the right binding cutline and is usable to guide in the cutting of a tip of the first end off along the right dog ear cutline, and wherein the left dog ear cutline intersects the left binding cutline and is usable to guide in the cutting of a tip of the second end off along the left dog ear cutline; and a left dog ear guideline, the left dog ear guideline being parallel to and spaced apart from the quilt edge line, wherein the left dog ear guideline is usable to align an edge of the binding for cutting a dog ear on the second end;

wherein the left binding cutline and the right binding cutline are spaced apart by about 7/16" to create the predefined overlap between the first end and the second end of the quilt binding when the first end is cut along the right binding cutline and the second end is cut along the left binding cutline;

positioning the cutting guide on top of a quilt so that the quilt edge line is directly above a raw edge of the quilt;

adjusting the position of the cutting guide so that the first end overlaps the right binding cutline when the first end is extended leftward along the raw edge of the quilt, and the second end overlaps the left binding cutline when the second end is extended rightward along the raw edge of the quilt;

positioning the first end on the cutting guide so that the raw binding edge proximate the first end is aligned along the quilt edge line;

cutting the first end along the right binding cutline;

positioning the second end on the cutting guide so that the raw binding edge proximate the second end is aligned along the quilt edge line; and cutting the second end along the left binding cutline.

14. The method of claim 13, wherein the quilt binding comprises a lengthwise fold, wherein the first end is unfolded before it is cut, and wherein the second end is unfolded before it is cut, and wherein cutting the first end creates a first cut end and wherein cutting the second end creates a second cut end, the method further comprising aligning the first cut end with the second cut end and sewing the first cut end to the second cut end when the binding is unfolded proximate the first cut end and the second cut end.

* * * * *